United States Patent [19]

Bizien et al.

[11] 3,944,168

[45] Mar. 16, 1976

[54] ARTILLERY PROJECTILE WITH SPREADING TAIL ASSEMBLY

[75] Inventors: Jean-Pierre Bizien, Chatillon-sous-Bagneux; Rene G. Patouilliart, Sevres; Michel George, Colombes, all of France

[73] Assignee: Etat Francais, Paris Armees, France

[22] Filed: Mar. 7, 1974

[21] Appl. No.: 449,090

[30] Foreign Application Priority Data

Mar. 14, 1973 France ..... 73.09023

[52] U.S. Cl. ..... 244/3.28

[51] Int. Cl.[2] ..... F42B 13/32

[58] Field of Search..... 244/3.27, 3.28, 3.29

[56] References Cited

UNITED STATES PATENTS

| | | | |
|---|---|---|---|
| 2,821,924 | 2/1958 | Hansen et al. | 244/3.28 |
| 3,098,446 | 7/1963 | Jasse | 244/3.28 |
| 3,196,793 | 7/1965 | Milenkovic et al. | 244/3.28 |
| 3,289,587 | 12/1966 | Donnelly et al. | 244/3.28 |

*Primary Examiner*—Verlin R. Pendegrass

*Attorney, Agent, or Firm*—Larson, Taylor & Hinds

[57] ABSTRACT

The invention relates to an artillery projectile with spreading tail assembly and a synchronization ring for controlling the orientation of the fins of the tail assembly. The synchronization ring slides on an extension of the projectile base and includes a first means cooperating with at least one piston seated in the projectile base to hold the synchronization ring in the forward position on the one hand, and on the other hand a second means cooperating with a projection of the respective fins to hold the fins in folded position inside the launcher tube when the synchronization ring is held in the forward position. The fins are spread when the ring moves to its rearward position. The movement of the ring may be under the control of one or more of the launching pressure at the projectile base, inertia, a specially generated pressure, rotational forces, or combinations of these.

14 Claims, 5 Drawing Figures

ARTILLERY PROJECTILE WITH SPREADING TAIL ASSEMBLY

FIELD OF THE INVENTION

The present invention relates to an artillery projectile with spreading tail assembly, which is to say an artillery projectile which may or may not be self-propelled, at the rear of which, as soon as it issues from the tube or barrel, a tail assembly is spread out, which tail assembly orients and stabilizes the projectile on its trajectory.

BACKGROUND AND SUMMARY

Such a spreading tail assembly, for a projectile that may or may not be self-propelled, must satisfy as completely as possible three — often four — technological imperatives:

1. In interior ballistics, i.e., while the projectile is within the tube, the tail assembly fins are thrust against the core of the tube by rotation of the projectile and by inertial forces, hence there is possibility of damage and wear to fins and tube. Therefore, the fins must be held in the folded position.

2. If there is a muzzle brake, the fins are thrust toward it by the rotation of the projectile and by the muzzle blast, with the same risks as above. Therefore, again the fins must be held in folded position.

3. As soon as the projectile emerges, the tail assembly and a certain opening of the fins are needed for stability of the projectile and for firing precision. It must therefore spread the tail assembly very rapidly (order of magnitude, 2 or 3 meters), and for the same reasons all fins must be spread simultaneously and suddenly.

4. On the trajectory, the spread tail assembly must have stable precise geometry, and this must moreover be faithfully reproducible from one projectile to another to have accurate firing.

In the present known state of the art, several systems of spreading tail assemblies have already been proposed.

In one of these known systems each fin, in the folded position, is held by a tie that is constituted by a platelet in the form of a cross which is ejected on issuing from the tube. This system does not meet the first imperative listed above. It is dangerous for the muzzle brake if there is one, and it is troublesome for persons operating the piece.

In another known system, each fin has a wear shoe that holds it in folded position, and that only opens under the effect of muzzle blast and projectile rotation. This system only responds to or meets the first two technological demands listed above, and in no way does it ensure simultaneity of the spreading of the respective fins.

In another known system which only refers to self-propelled projectiles, the outlet nozzle is movable, retracting on ignition of the propellant charge. In so doing, it stops clamping the fins in the folded position, but the propellant charge is ignited by a pyrotechnic delay triggered by the departure of the round. This system thus depends upon the delay and its dispersion, and it does not respond positively to any of the four technological requirements already mentioned.

A spreadable tail assembly for self-propelled projectile is also known from French Pat. No. 1,270,054. The fins of such a projectile are combined there with a thrust device concentric to the longitudinal axis of the tail assembly, and movable along this axis between a position in which the fins are folded down and a rear position in which the fins are spread and held in this position by the thrust device, said device being in turn combined with means to exert on it an axial thrust that tends to move it from the forward position to the rear position. Though this system effectively allows a sudden and simultaneous spreading of the fins as well as their clamping after issuing from the launcher tube, it does not resolve the problem of holding the fins in folded position in the launcher tube and during passage of the muzzle brake. Now, it is essential for good firing, especially when a rifled tube is used and when the initial velocity is high and the acceleration strong, that the fins not be thrust against the core of the tube and toward the muzzle brake. If this happens, on the one hand the fins are damaged, spreading poorly and not performing their function during the flight of the projectile, and on the other hand there is abnormal wear on the tube.

The present invention alleviates these drawbacks and deficiencies and allows the four imperatives that were listed to be fully satisfied.

The present invention relates to an artillery projectile with spreading tail assembly which comprises on the one hand fins that each pivot in a plane passing through the longitudinal axis of the projectile, about an axis perpendicular to said plane, the said fins having an internal edge that presents at least one projection and, on the other hand, a synchronization ring slidable concentrically with reference to an extension of the projectile base from a forward position to a rear position to cause simultaneous spreading of the fins and ensure their clamping in the spread position, the said projectile being characterized in that the synchronization ring has on the one hand a first means cooperating with at least one piston seated in the projectile base, such that the rear surface of said piston is subjected to the pressure prevailing in the launcher tube, to hold the synchronization ring in the forward position, and on the other hand a second means cooperating with said projection of the respective fins, to hold the fins in folded position inside the tube when the synchronization ring is held in the forward position.

Said first means may be an annular groove in which a cap of said piston engages.

Said second means may be a second annular groove in which there engages the said projection of the respective fins.

In a preferred embodiment, said first and second means are one and the same groove in which there are simultaneously engaged a cap of said piston and said projections of the respective fins.

Another object of the present invention is to provide a projectile as described above, characterized in that the piston is a differential piston, on the front small face of which the gases act that are produced by a generator of pyrotechnic gas. Preferably but not necessarily the movement of the differential piston (or differential pistons) disengages the back of the large surface of the piston from the cylinder, further to accelerate its movement.

In a special form of embodiment, the gas generator operates by using gas in the tube to actuate the differential piston, for example, by means of an auxiliary piston, uncovering a set of ports.

In brief, according to the present invention, at the departure of the round the considerable pressure prevailing in the launch tube and then the hold the pressure holdthe piston or pistons in the forward position. The piston or pistons hold the synchronization ring in the forward position and the fins are thus held in the folded position by means of a projection engaged in an annular groove of the said synchronization ring.

BRIEF DESCRIPTION OF THE DRAWINGS

The invention will be better understood from the ensuing description of the drawings which are given as non-limitative examples, wherein.

DETAILED DESCRIPTION OF THE PREFERRED EMBODIMENTS

Figure 1:
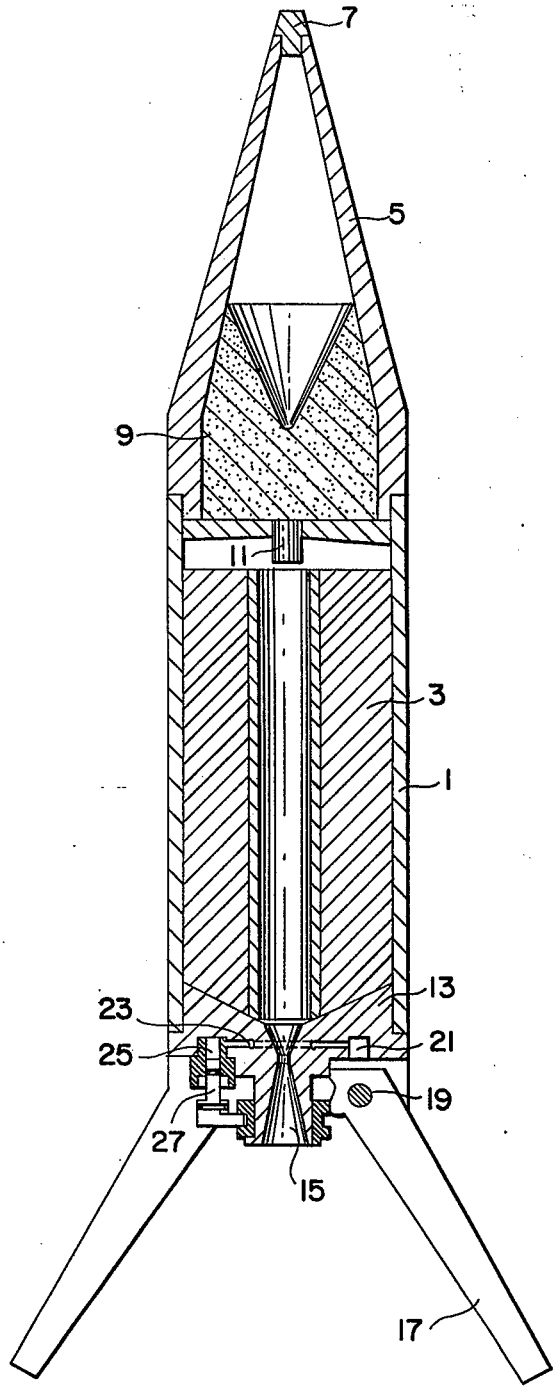
FIG. 1 is an axial section of a projectile furnished with a device of the invention, incorporating a motorizing system using gases emitted by a pyrotechnic generator.

FIG. 1 shows a self-propelled projectile, 105 mm caliber, it being understood that the invention is not limited to this caliber or to this type of projectile.

Figure 2:
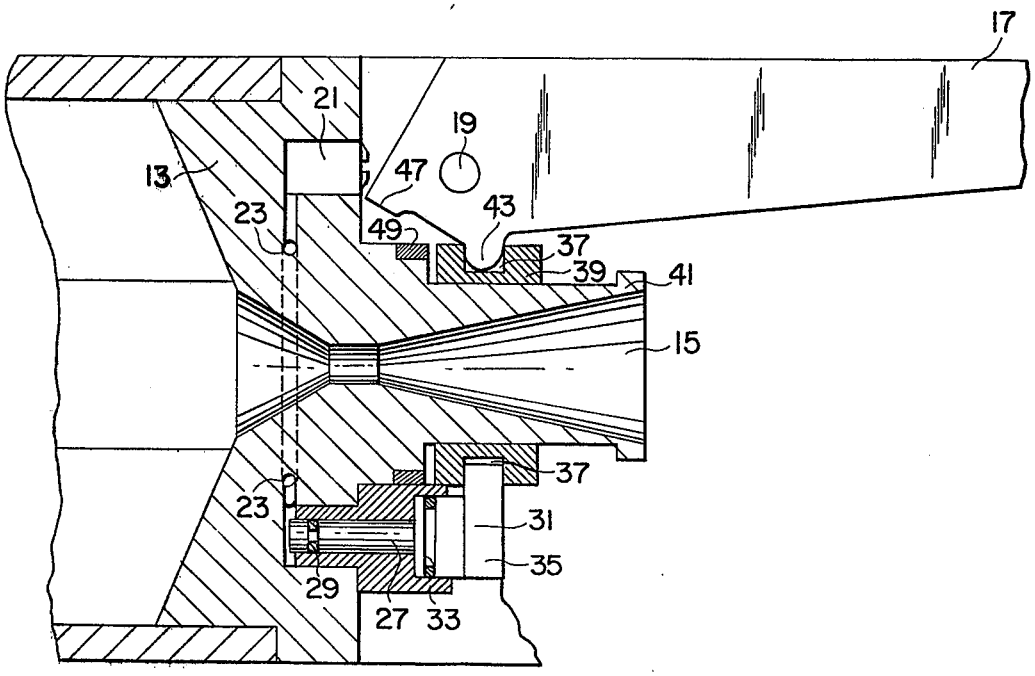
FIGS. 2 and 3 are axial section views of the base part of FIG. 1, that is, wherein pistons are moved by gases emitted by one or more pyrotechnic generators.
Figure 3:
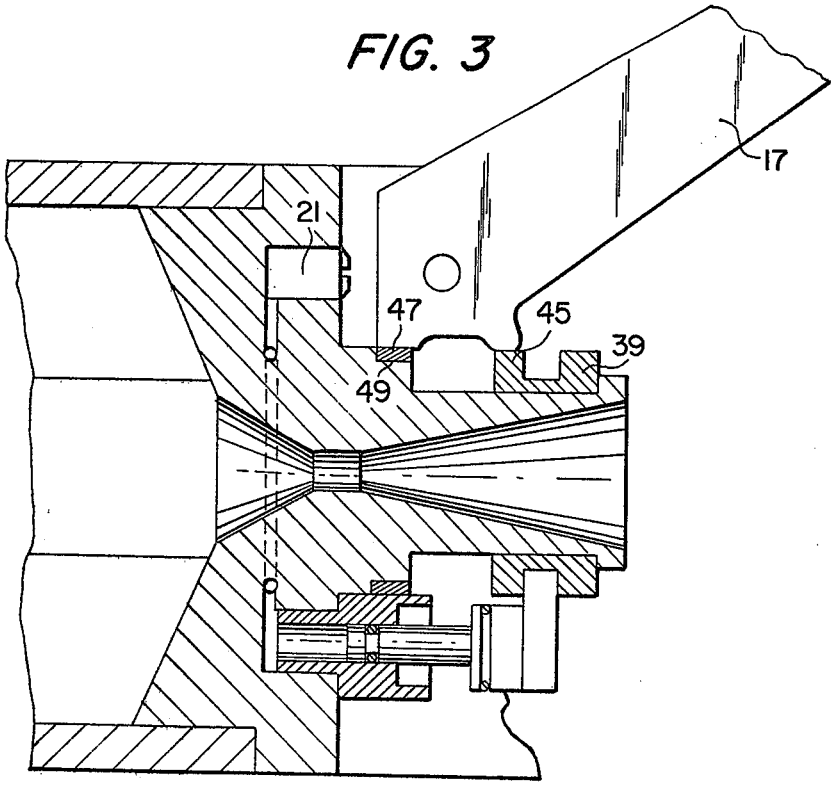

In the conventional way, this projectile comprises (FIGS. 1–3) a body 1, containing a propellant charge 3, a head 5 with a fuze 7, an explosive charge 9, an igniter 11, and a base 13 with a nozzle 15 and four fins 17 pivoted at 19 on the base. According to the invention, at least one gas generator 21 is mounted in base 13, where it is tightly fixed, e.g. by screwing and bonding, and it feeds a toric groove 23, which feeds the chambers of the small face 25 of differential pistons 27 (there being four in the present embodiment, where only one is shown in the figures). Differential piston 27 is sealed by a toric seal 29 such as an O-ring. Its large face 31, with a toric seal 33, is uncovered. Differential piston 27 has a cap 35 that is in engagement in an annular groove 37 of synchronization ring 39. The synchronizing ring slides on that part of base 13 that forms a nozzle 15, from the forward position that corresponds to the folded fin position, to a stop formed by a stop ring 41. Fins 17, pivoted at 19 on base 13 as already mentioned, are each furnished with a tooth 43 which, before the departure of the round (FIG. 2), is engaged in annular groove 37 of synchronization ring 39, and in trajectory (FIG. 3) bears on a circular shoulder 45 of synchronizing ring 39. Finally, each fin 17 has a flattened portion 47 which in trajectory (FIG. 3) bears on a damping ring 49, made of softer metal, of base 13.

The functioning of this embodiment of the invention will be apparent. On departure of the round, there is rapidly established on the rear face of base 13 a pressure that is considerable. The projectile then starts to move. Under the effect of this, by inertia, the gas generator or generators 21 function and direct onto the small faces 25 of pistons 27 a pressure whose magnitude depends only upon the pyrotechnic charge of generator 21.

The differential piston 27 at this moment is subjected to a series of opposed forces:

closing forces due to the pressure prevailing in the chamber of the launcher, applied to the large face 35 of piston or pistons 27;

friction forces, difficult to evaluate, which oppose any movement;

opening forces due first to the counter pressure applied to the small face 25 of piston 27 and then to (possible) rotation of the projectile and the fins, transmitted by synchronization ring 39, and finally to inertial forces developed by pistons 27 themselves, synchronization ring 39 and fins 17 according to the position of their center of gravity. These inertial forces may be considerable in the case wherein the projectile is fired from a gun, when acceleration may reach or exceed 40,000 times that of gravity.

It is easy, however, to make the closing force preponderant during the passage of the projectile through the launch tube, the main control parameters being on the one hand the motorizing counterpressure, and on the other hand the ratio of the differential faces of the piston (small face 25, large face 35).

Considerable acceleration of the projectile is not a difficulty in any case, since this acceleration is in fact, like the closing force, in proportion to the pressure prevailing in the launcher chamber.

In passage of a possible muzzle brake, the closing force rapidly diminishes, but it sufficiently slows the spreading of the fins 17 which do not have time to touch the muzzle brake.

Beyond the muzzle brake, under the effect of the (possible) rotation and the motorizing pressure, the synchronization ring 39, thrust by pistons 27, entrains teeth 43 of fins 17.

In a given position, determined by the configuration of teeth 43, ring 39 escapes to stop 41. Fins 17 are then stopped between shoulder 45 of synchronization ring 39 on the one hand and damping ring 49 (FIG. 3) on the other. The role of this damping ring 49, made of soft material (plastic, copper, lead, aluminum alloy, etc.) is to absorb the major part of the kinetic energy of fins 17 by inelastic shock, and thus to reduce the pulses transmitted to the projectile at the time of stopping.

Figure 4:
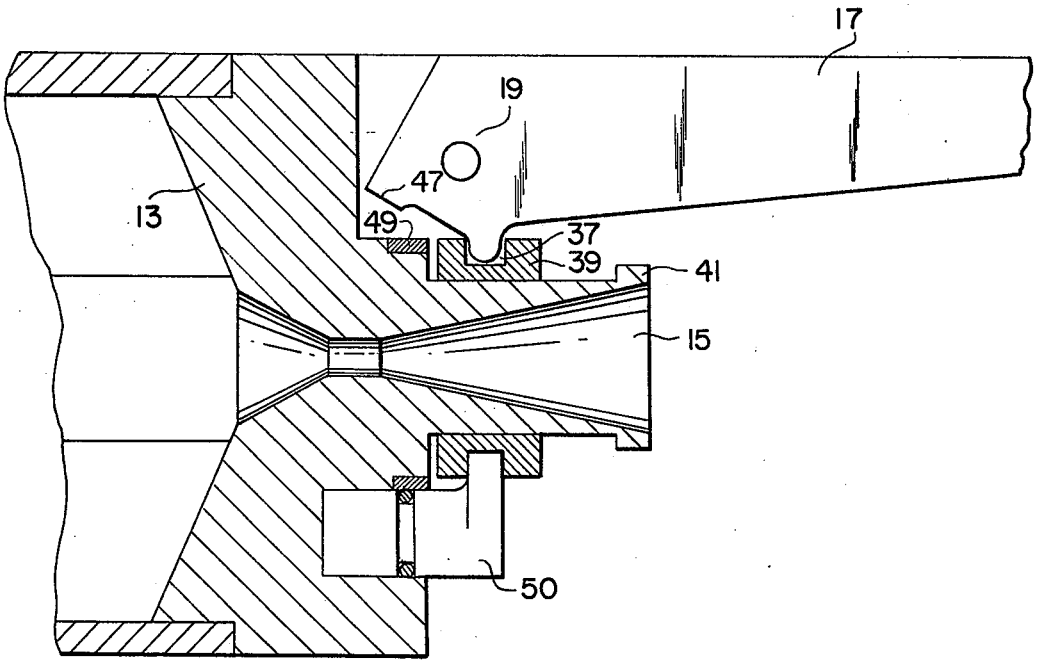
FIG. 4 is an axial view of the base part of a second embodiment wherein the piston or pistons are not driven by gases emitted by a pyrotechnic generator.

In the embodiment shown in FIG. 4, the arrangement of the constituent elements of the invention has not been varied, but the pyrotechnical generators have been left out. The piston or pistons are no longer necessarily differential. The operation of the device inside the launch tube is the same as in the earlier embodiment. The opening of the fins, outside the launch tube, is the result of the conjugated action of the muzzle blast, the possible rotation of the projectile, and inertial forces developed by the pistons and the synchronization ring themselves.

Figure 5:
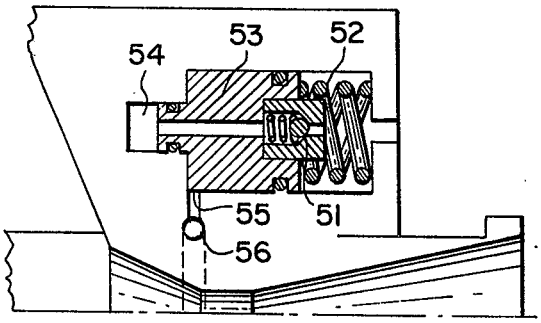
FIG. 5 is an axial section of a base part of a third embodiment wherein the pistons are driven by gases bled in the launch tube.

FIG. 5 schematically shows a gas bleed device in the base. Because of the strong pressure prevailing inside the tube during departure of the round, ball 51 of ball valve 52 of auxiliary piston 53 allows a certain amount of high pressure gas to pass, which gas accumulates in chamber 54. Beyond the launch tube the pressure prevailing in 54 will move piston 53, to uncover port or ports 55. The gases in 54 will flow via groove 56 and act on small faces 25 of differential pistons 27 in much the same manner as previously described in connection with FIGS. 1–3.

We claim:

1. In an artillery projectile for launching by means of a launch tube, the combination comprising a spreading tail assembly on the base of the projectile, said tail assembly comprising fins that respectively pivot in a plane that passes through the longitudinal axis of the projectile, about an axis perpendicular to said plane, said fins having an internal edge with at least one projection, means forming an extension of the projectile base, a synchronization ring slidable concentrically on said extension of the projectile base from a forward position to a rear position to cause the simultaneous spreading of the fins and ensure their clamping in the spread position, means forming at least one axially oriented cylinder in the projectile base, a piston slidably mounted in each such cylinder for movement between forward and rear positions and constructed and arranged such that the rear face of said piston will be subjected to the pressure prevailing at the rear of the projectile base and hence the pressure in a launch tube during departure of the projectile, said synchronization ring having, on the one hand, first means cooperating with said at least one piston slidably seated in said cylinder in the projectile base, such that the rear face of said piston will be subjected to the pressure prevailing in a launch tube during departure of the round, to hold the synchronization ring in the forward position with said piston because of launch tube pressures during firing, and, on the other hand, second means cooperating with the said projections of the respective fins to hold the fins in folded position inside the launcher tube when the synchronization ring is held in the forward position, and gas pressure means for subjecting the forward face of said piston to gas pressure during launching, said gas pressure means comprising an enclosed space in said projectile base, means for pressurizing said space during launching, and means for preventing egress of gas from said space at least until destruction of said projectile, such that said gas pressure acts against said forward face of said piston throughout substantially the entire flight of said projectile.

2. Projectile as in claim 1, wherein said first means is an annular groove in which a cap of said piston engages.

3. Projectile as in claim 1 wherein said second means is an annular groove in which said projections of the respective fins engage.

4. Projectile as in claim 1 wherein said first and second means comprise a single annular groove in which there are simultaneously engaged a cap of said piston and said projections of the respective fins.

5. Projectile as in claim 1 wherein said gas pressure means includes gas generator means, and wherein the piston is a differential piston on the forward small face of which the gases produced by the gas generator means act.

6. Projectile as in claim 5 characterized in that said generator means comprises means for bleeding gas from a launch tube, in which the projectile is located during firing, into a space in the projectile and subsequently to the small face of said differential piston.

7. Projectile as in claim 6 wherein said means for bleeding gas comprises a one-way valve in said base for effecting one-way flow of gas from the area adjacent the rear face of the base to a space in the projectile, and means for feeding gas from said space to the small face of said differential piston in dependence on the relative pressures in said space and the area adjacent the rear face of the base of the projectile.

8. Projectile as claimed in claim 1 wherein said piston and its cylinder are oriented with their axis parallel to but radially offset from the axis of the projectile, said synchronization ring is slidably mounted on said axial extension of the base of the projectile, and said first means operatively couples said piston to said ring so as to prevent rearward movement of said ring apart from said piston.

9. Projectile as claimed in claim 8 wherein said second means comprises means on said ring for holding the projection of each fin in captive relationship when said fins are in the folded position and said ring is in its forward position, whereby to prevent spreading of said fins until said ring moves rearwardly from its forward position.

10. Projectile as claimed in claim 7 wherein said means for feeding gas from said space to the small face of said differential piston comprises a pressure responsive slide valve having one face exposed to pressure in said space and an opposite face exposed to pressure adjacent the rear face of said projectile, a passage for communicating said space and the small face of said differential piston, and means biasing said slide valve to a normal position in which it closes said passage, said slide valve being oriented such that pressure in said space acts on said one face to urge said slide valve to a position in which it opens said passage, and such that pressure acting on said opposite face urges said slide valve to a position in which it closes said passage.

11. Projectile as claimed in claim 10 wherein said oneway valve is located in and controls a passage in said slide valve connecting said one face and said opposite face.

12. Projectile as claimed in claim 11 wherein said slide valve is a differential piston, said one face constituting the small face and said opposite face constituting the large face thereof.

13. Projectile as claimed in claim 5 wherein said differential piston has a forward small face, a rear large face, and an intermediate face oriented oppositely from said rear large face, said cylinder having a portion housing said intermediate face at least while said piston is in its forward position so that said intermediate face is sealed from the gas pressures prevailing on said forward and rear faces, said cylinder being constructed and arranged such that said intermediate face is opened to the pressure prevailing on said rear large face at a predetermined point in the movement of said piston from its forward to its rearward position, whereby to increase the effective gas pressure thrust on said piston in the rearward direction.

14. Projectile as claimed in claim 1 wherein said synchronization ring encompasses and is slidably mounted on at least a portion of said extension, and said piston comprises a differential piston having a relatively small forward face and a relatively large rear face, said piston being disposed radially outwardly from said synchronization ring.

* * * * *